US009501983B2

(12) United States Patent
Tatsuno et al.

(10) Patent No.: US 9,501,983 B2
(45) Date of Patent: Nov. 22, 2016

(54) COLOR CONVERSION DEVICE, DISPLAY DEVICE, AND COLOR CONVERSION METHOD

(71) Applicant: Japan Display Inc., Tokyo (JP)

(72) Inventors: Hirokazu Tatsuno, Tokyo (JP); Toshiyuki Nagatsuma, Tokyo (JP); (Continued)

(73) Assignee: Japan Display Inc., Tokyo (JP)

( * ) Notice: Subject to any disclaimer, the term of this patent is extended or adjusted under 35 U.S.C. 154(b) by 100 days.

(21) Appl. No.: 14/172,469

(22) Filed: Feb. 4, 2014

(65) Prior Publication Data

US 2014/0218386 A1 Aug. 7, 2014

(30) Foreign Application Priority Data

Feb. 7, 2013 (JP) ..... 2013-022718

(51) Int. Cl.
*G09G 3/36* (2006.01)
*G09G 5/02* (2006.01)

(52) U.S. Cl.
CPC ..... *G09G 3/3607* (2013.01); *G09G 3/3648* (2013.01); *G09G 5/02* (2013.01); (Continued)

(58) Field of Classification Search
CPC ..... G09G 3/3607
See application file for complete search history.

(56) References Cited

U.S. PATENT DOCUMENTS 7,728,846 B2 * 6/2010 Higgins ..... G09G 3/2003 345/589
2003/0179211 A1 * 9/2003 Wada ..... H04N 9/73 345/589

(Continued)

FOREIGN PATENT DOCUMENTS

CN 102347010 A 2/2012
CN 102577397 A 7/2012

(Continued)

OTHER PUBLICATIONS

Korean Office Action issued Feb. 4, 2015 for corresponding Korean Application No. 10-2014-12598.

(Continued)

*Primary Examiner* — Joni Richer
*Assistant Examiner* — Grace Q Li
(74) *Attorney, Agent, or Firm* — Michael Best & Friedrich LLP

(57) ABSTRACT

According to an aspect, a color conversion device includes a signal processing unit and a signal output unit. When a color specified in a predetermined color space by color data based on input signals is a color outside a defined color gamut defined in the color space, the signal processing unit generates in-defined-gamut data, and when the color specified in the color space by the color data based on the input signals is a color on a border of or inside the defined color gamut, the signal processing unit does not convert the color data based on the input signals into color data of a color different from that specified by the color data based on the input signals, and generates in-defined-gamut data identical to the color data based on the input signals, and. The signal processing unit generates output signals based on the in-defined-gamut data.

11 Claims, 6 Drawing Sheets

(72) Inventors: Akira Sakaigawa, Tokyo (JP); Masaaki Kabe, Tokyo (JP)

(52) U.S. Cl.
CPC ..... *G09G 2300/0452* (2013.01); *G09G 2320/0276* (2013.01); *G09G 2320/0646* (2013.01); *G09G 2340/06* (2013.01)

(56) References Cited

U.S. PATENT DOCUMENTS

| | | | | |
|---|---|---|---|---|
| 2003/0234794 | A1 | 12/2003 | Kanai | |
| 2008/0150863 | A1 | 6/2008 | Morisue et al. | |
| 2009/0160747 | A1 | 6/2009 | Morisue et al. | |
| 2011/0012920 | A1* | 1/2011 | Saigo | G06T 11/001 345/601 |
| 2012/0026211 | A1* | 2/2012 | Kikuchi et al. | 345/690 |
| 2012/0163717 | A1* | 6/2012 | Cho et al. | 382/167 |
| 2012/0194539 | A1* | 8/2012 | Zhang | 345/590 |
| 2013/0050245 | A1* | 2/2013 | Longhurst et al. | 345/590 |

FOREIGN PATENT DOCUMENTS

| | | | |
|---|---|---|---|
| CN | 102893610 | A | 10/2013 |
| JP | 2002-116750 | A | 4/2002 |
| JP | 2008-026339 | A | 7/2008 |
| JP | 2008-176247 | | 7/2008 |
| JP | 2009-86053 | | 4/2009 |
| JP | 2009-182415 | A | 8/2009 |
| TW | I231715 | B | 4/2005 |
| WO | WO-2011/061954 | A1 | 5/2011 |

OTHER PUBLICATIONS

Chinese Office Action issued Sep. 6, 2015 for corresponding Chinese Application No. 201410045326.6.

Taiwanese Office Action issued Jan. 13, 2016 for corresponding Taiwanese Application No. 103102006.

Japanese Office Action issued Feb. 23, 2016 for corresponding Japanese Application No. 2013-022718.

* cited by examiner

COLOR CONVERSION DEVICE, DISPLAY DEVICE, AND COLOR CONVERSION METHOD

CROSS-REFERENCE TO RELATED APPLICATIONS

This application claims priority from Japanese Application No. 2013-022718, filed on Feb. 7, 2013, the contents of which are incorporated by reference herein in its entirety.

BACKGROUND

1. Technical Field

The present disclosure relates to a color conversion device, a display device, and a color conversion method that convert input signals into output signals for displaying the image within a predetermined range of a color gamut, and display the colors of the image within the color gamut.

2. Description of the Related Art

Conventionally employed is a liquid crystal display device with an RGBW liquid crystal panel in which a pixel W (white) is added to pixels R (red), G (green), and B (blue). The RGBW liquid crystal display device displays an image while partially allocating, to the pixel W, transmission amounts of light from a backlight through the pixels R, G, and B based on RGB data that determines the image display, thus making it possible to reduce luminance of the backlight so as to reduce power consumption.

However, an image having high saturation does not allow the transmission amounts of light from the backlight to be partially allocated to the pixel W, or reduces the amount of allocation, thus being incapable of reducing the power consumption of the backlight. To solve this problem, a liquid crystal display device (refer to Japanese Patent Application Laid-open Publication No. 2008-176247 [JP-A-2008-176247]) reduces the saturation of the image having high saturation to increase the transmission amount of light of the backlight allocable to the pixel W so as to reduce the power consumption of the backlight.

However, the liquid crystal display device disclosed in JP-A-2008-176247 reduces the saturation of all colors of the image based on the RGB data, so that visual quality of the displayed image can deteriorate. In particular, a change also occurs in visual quality of memory colors (such as human flesh color and blue colors of the sky) to which human visual characteristics are sensitive, so that an influence of display quality deterioration in the displayed image can be greater than that before the saturation is reduced.

For the foregoing reasons, there is a need for a color conversion device, a display device, and a color conversion method that is capable of suppressing the display quality deterioration due to reduction in saturation of an image.

SUMMARY

According to an aspect, a color conversion device includes a signal processing unit that generates output signals to control operations of pixels of a display unit based on input signals input from outside; and a signal output unit that outputs driving signals of the pixels based on the output signals generated by the signal processing unit. When a color specified in a predetermined color space by color data based on the input signals is a color outside a defined color gamut defined in the color space, the signal processing unit generates in-defined-gamut data that specifies a color on a border of or inside the defined color gamut, and when the color specified in the color space by the color data based on the input signals is a color on the border of or inside the defined color gamut, the signal processing unit does not convert the color data based on the input signals into color data of a color different from that specified by the color data based on the input signals, and generates in-defined-gamut data identical to the color data based on the input signals, and. The signal processing unit generates the output signals based on the in-defined-gamut data.

According to another aspect, a display device includes a display unit in which the pixels are arranged in a two-dimensional matrix; and a color conversion device. The color conversion device includes a signal processing unit that generates output signals to control operations of pixels of the display unit based on input signals input from outside, and a signal output unit that outputs driving signals of the pixels based on the output signals generated by the signal processing unit. When a color specified in a predetermined color space by color data based on the input signals is a color outside a defined color gamut defined in the color space, the signal processing unit generates in-defined-gamut data that specifies a color on a border of or inside the defined color gamut, when the color specified in the color space by the color data based on the input signals is a color on the border of or inside the defined color gamut, the signal processing unit does not convert the color data based on the input signals into color data of a color different from that specified by the color data based on the input signals, and generates in-defined-gamut data identical to the color data based on the input signals, and the signal processing unit generates the output signals based on the in-defined-gamut data.

According to another aspect, a color conversion method includes performing a first color conversion of generating defined color gamut determination data for determining, based on color data based on input signals, whether a color specified by the color data is a color on a border of or inside a defined color gamut defined in a predetermined color space; determining, based on the defined color gamut determination data, whether the color specified by the color data based on the input signals is a color on the border of or inside the defined color gamut; generating correction data by correcting the defined color gamut determination data so that the color is determined to be a color on the border of or inside the defined color gamut when the specified color is determined to be a color outside the defined color gamut at the determining, and generating correction data identical to the defined color gamut determination data without change when the specified color is determined to be a color on the border of or inside the defined color gamut at the determining; and performing a second color conversion of generating, based on the correction data, the in-defined-gamut data that specifies the color on the border of or inside the defined color gamut.

DETAILED DESCRIPTION

Embodiments of the present disclosure will be described in detail in the order given below with reference to the accompanying drawings.

1. First embodiment
2. Second embodiment
3. Aspects of present disclosure

1. First Embodiment

1-1. Configuration of Liquid Crystal Display Apparatus 10

Figure 1:
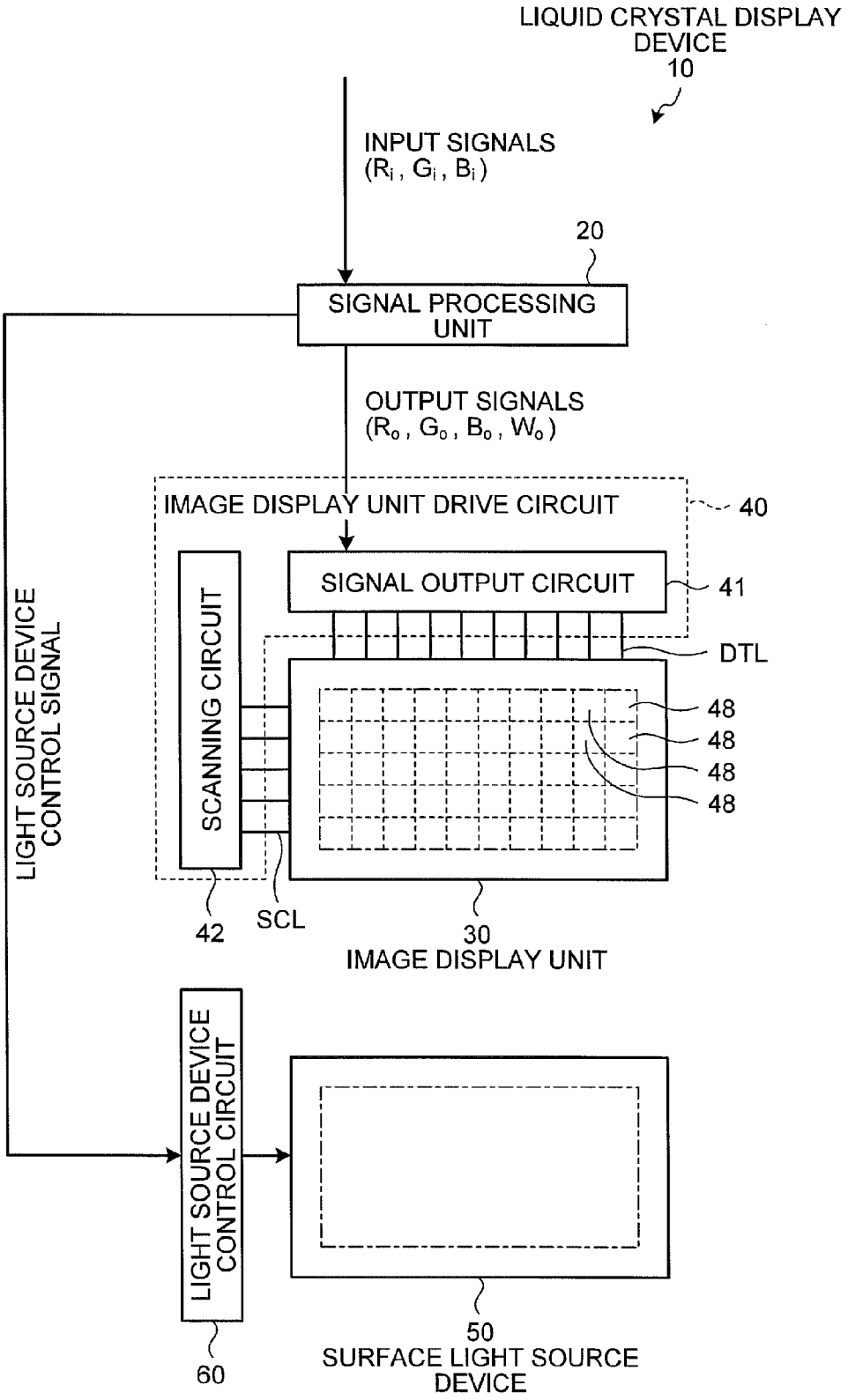
FIG. 1 is a block diagram illustrating an example of a configuration of a liquid crystal display device according to a first embodiment of the present disclosure.
Figure 2:
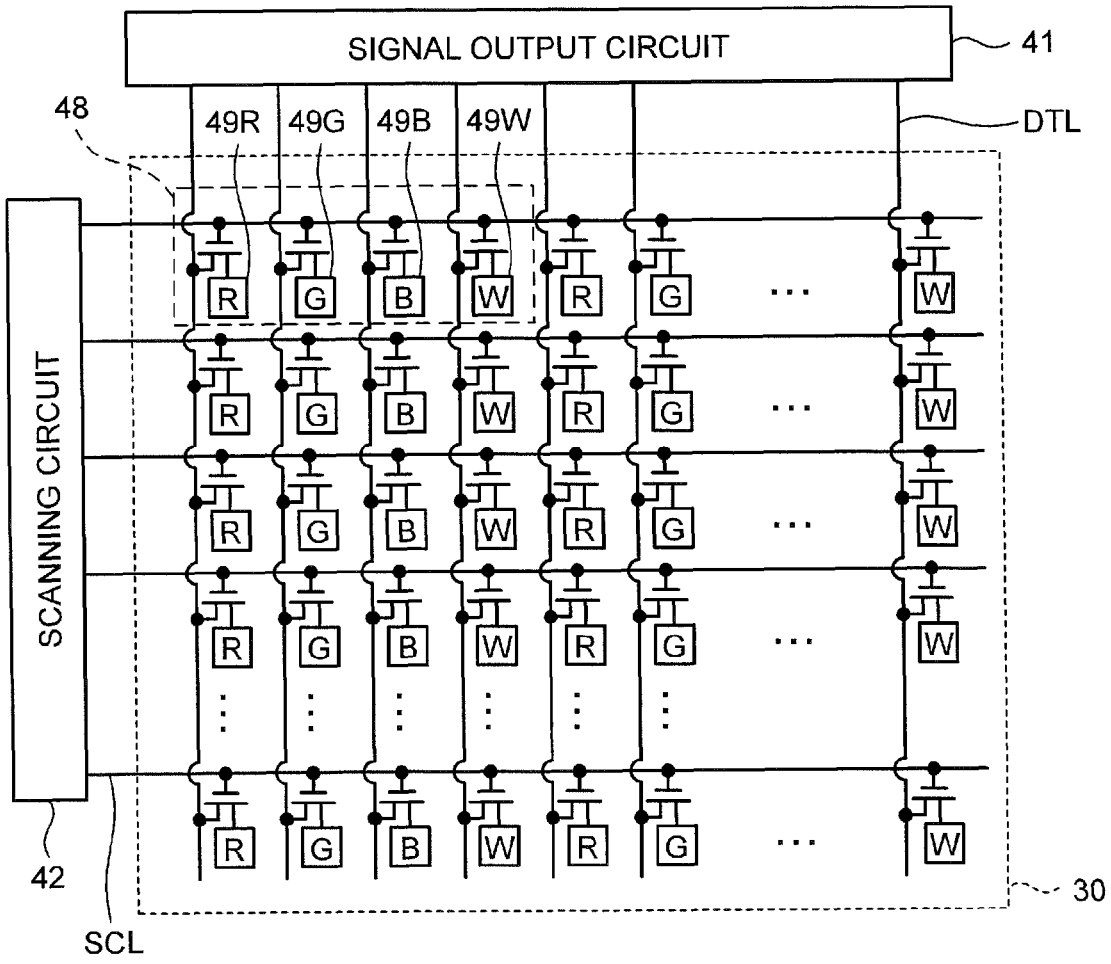
FIG. 2 is a wiring diagram of an image display unit and an image display unit drive circuit in the liquid crystal display device of FIG. 1.

FIG. 1 is a block diagram illustrating an example of a configuration of a liquid crystal display device according to a first embodiment of the present disclosure. FIG. 2 is a wiring diagram of an image display unit and an image display unit drive circuit in the liquid crystal display device of FIG. 1. The configuration of this liquid crystal display device 10 according to the present embodiment will be described with reference to FIGS. 1 and 2. In the present embodiment, the liquid crystal display device 10 using liquid crystals will be described as an example of a display device. However, the display device is not limited to this, but may be, for example, a display device using organic EL.

As illustrated in FIG. 1, the liquid crystal display device 10 according to the present embodiment includes a signal processing unit 20 that receives and processes input signals (RGB data) with predetermined data conversion processing, and outputs the results; an image display unit that displays an image based on the output signals output from the signal processing unit 20; an image display unit drive circuit 40 that controls the display operation of the image display unit 30; a surface light source device 50 that emits white light in a planar manner to the image display unit 30 from the back side thereof; and a light source device control circuit 60 (light source device control unit) that controls the operation of the surface light source device 50. The liquid crystal display device 10 has the same configuration as that of an image display unit assembly disclosed in Japanese Patent Application Laid-open Publication No. 2011-154323 (JP-A-2011-154323), and various modifications disclosed in JP-A-2011-154323 are applicable to the liquid crystal display device 10.

The signal processing unit 20 is an arithmetic processing unit that controls the operations of the image display unit 30 and the surface light source device 50. The signal processing unit 20 is electrically coupled with the image display unit drive circuit 40 that drives the image display unit 30 and with the light source device control circuit 60 that drives the surface light source device 50. The signal processing unit 20 performs the data processing to input signals (RGB data) from outside to generate and output the output signals and a light source device control signal. Specifically, the signal processing unit 20 performs predetermined color conversion processing to input signals (Ri, Gi, Bi) that are the RGB data represented as an energy ratio of red (R), green (G), and blue (B), as will be described later, and generates output signals (Ro, Go, Bo, Wo) represented as an energy ratio of red (R), green (G), blue (B), and white (W) obtained by further adding white (W) as a fourth color. The signal processing unit 20 outputs the generated output signals (Ro, Go, Bo, Wo) to the image display unit drive circuit 40, and the light source device control signal to the light source device control circuit 60. The input signals (Ri, Gi, Bi) are the RGB data representing, for example, a certain color in the sRGB color space.

The image display unit 30 is a color liquid crystal display device, and, as illustrated in FIG. 2, is arranged in a two-dimensional matrix with pixels 48, each including a first sub-pixel 49R that displays a first color (red), a second sub-pixel 49G that displays a second color (green), a third sub-pixel 49B that displays a third color (blue), and a fourth sub-pixel 49W that displays a fourth color (white). A first color filter transmitting light of the first color (red) is disposed between the first sub-pixel 49R and a display surface of the image display unit 30; a second color filter transmitting light of the second color (green) is disposed between the second sub-pixel 49G and the display surface of the image display unit 30; and a third color filter transmitting light of the third color (blue) is disposed between the third sub-pixel 49B and the display surface of the image display unit 30. A transparent resin layer transmitting light of all colors is disposed between the fourth sub-pixel 49W and the display surface of the image display unit 30. The configuration may be such that nothing is provided between the fourth sub-pixel 49W and the display surface of the image display unit 30.

In the example of the image display unit 30 illustrated in FIG. 2, the first sub-pixel 49R, the second sub-pixel 49G, the third sub-pixel 49B, and the fourth sub-pixel 49W are arranged in an array similar to a stripe array. The configuration and arrangement of the sub-pixels included in one pixel is not limited. For example, the first sub-pixel 49R, the second sub-pixel 49G, the third sub-pixel 49B, and the fourth sub-pixel 49W may be arranged in an array similar to a diagonal array (mosaic array) in the image display unit 30. The sub-pixels may be arranged, for example, in an array similar to a delta array (triangular array) or a rectangular array. The array similar to a stripe array is generally preferable for displaying data and strings on a personal computer and the like. The array similar to a mosaic array is preferable for displaying a natural image on a video camera recorder, a digital still camera, and the like.

The image display unit drive circuit 40 includes a signal output circuit 41 (signal output unit) and a scanning circuit 42. As illustrated in FIG. 2, the signal output circuit 41 is electrically coupled by wiring DTL to the sub-pixels in the respective pixels 48 of the image display unit 30. Based on each of the output signals (Ro, Go, Bo, Wo) output from the signal processing unit 20, the signal output circuit 41 outputs a driving voltage applied to liquid crystals included in each of the sub-pixels, and thus controls the transmittance of each of the pixels for the light emitted from the surface light source device 50. As illustrated in FIG. 2, the scanning circuit 42 is electrically coupled by wiring SCL to switching elements for controlling operations of the sub-pixels in the respective pixels 48 of the image display unit 30. The scanning circuit 42 sequentially outputs scanning signals to a plurality of wirings SCL, thus applying the scanning signals to the switching elements of the sub-pixels of the respective pixels 48 so as to turn on the switching elements. For the sub-pixel to which the scanning signal of the scanning circuit 42 is applied, the signal output circuit 41 applies the driving voltage to the liquid crystals included in the sub-pixel. In this manner, an image is displayed on the entire screen of the image display unit 30.

The surface light source device 50 is disposed on the back side opposite to the image display surface of the image display unit 30, and emits the white light toward a substantially entire surface of the image display unit 30.

Based on the light source device control signal output from the signal processing unit 20, the light source device control circuit 60 outputs a driving voltage for making the surface light source device 50 emit the white light, and thus controls the amount of the light (intensity of the light).

1-2. Structure of Image Display Device 30

Figure 3:
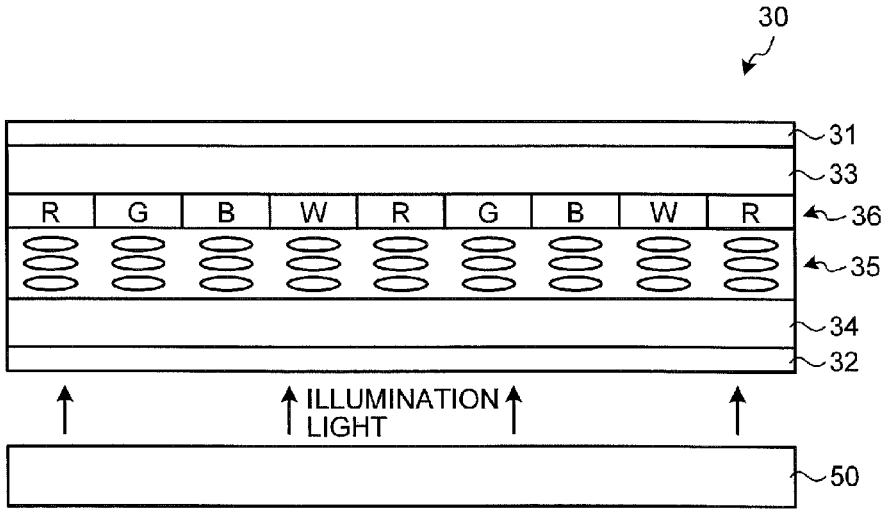
FIG. 3 is a schematic sectional view of the image display unit in the liquid crystal display device of FIG. 1.

FIG. 3 is a schematic sectional view of the image display unit in the liquid crystal display device of FIG. 1. A structure of the image display unit 30 of the present embodiment will be described with reference to FIG. 3.

As illustrated in FIG. 3, the image display unit 30 of the liquid crystal display device 10 according to the present embodiment includes a pair of transparent substrates 33 and 34, a liquid crystal layer 35 disposed between the transparent substrates 33 and 34, polarizing plates 31 and 32 disposed outside the transparent substrates 33 and 34, respectively, and a color filter 36 disposed between the transparent substrate 33 and the liquid crystal layer 35.

The polarizing plates 31 and 32 control transmission of the light emitted from the surface light source device 50.

While not illustrated in FIG. 3, electrodes and the wirings DTL and SCL for applying the voltages to the liquid crystals of the liquid crystal layer 35, and the switching elements for controlling the operations of the sub-pixels of the respective pixels 48 are mounted on the transparent substrates 33 and 34, which have an effect of keeping electricity in the electrodes from leaking to other portions.

The liquid crystal layer 35 regulates the transmittance of the light according to the amount of the applied voltage, and uses liquid crystals driven by one of various modes, such as a twisted nematic (TN) mode, a vertical alignment (VA) mode, and an electrically controlled birefringence (ECB) mode.

The color filter 36 is provided between the image display side transparent substrate 33 and the liquid crystal layer 35, and is configured such that, for example, the color filter layers of three colors of red (R), green (G), and blue (B) (the first, the second, and the third color filters described above) and the transparent resin layer (white [W]) transmitting all colors are periodically arranged.

While not illustrated in FIG. 3, an alignment film is provided between the transparent substrate 34 and the liquid crystal layer 35, and between the liquid crystal layer 35 and the color filter 36. The alignment film has an effect of aligning liquid crystal molecules of the liquid crystal layer 35 in a constant direction.

1-3. Configuration of Signal Processing Unit 20

Figure 4:
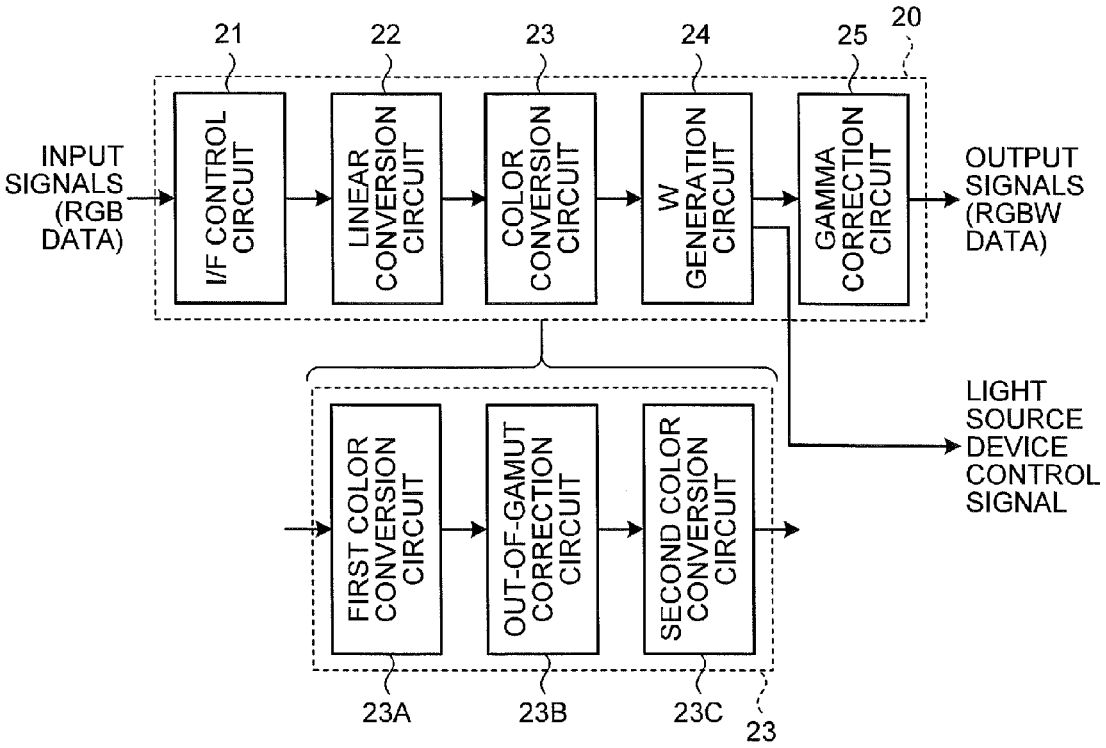
FIG. 4 is a block configuration diagram of a signal processing unit in the liquid crystal display device of FIG. 1.

FIG. 4 is a block configuration diagram of the signal processing unit in the liquid crystal display device of FIG. 1. The configuration of the signal processing unit 20 of the present embodiment will be described with reference to FIG. 4.

As illustrated in FIG. 4, the signal processing unit 20 of the liquid crystal display device 10 according to the present embodiment includes an I/F control circuit 21, a linear conversion circuit 22 (linear conversion unit), a color conversion circuit 23, a W generation circuit 24 (four-color generation unit), and a gamma correction circuit 25 (gamma correction unit). The color conversion circuit 23 includes a first color conversion circuit 23A (first color conversion unit), an out-of-gamut correction circuit 23B (out-of-gamut correction unit), and a second color conversion circuit 23C (second color conversion unit).

The I/F control circuit 21 is an interface that externally receives the input signals (Ri, Gi, Bi) that are information (RGB data) of an image. Specifically, the I/F control circuit 21 converts the externally received input signals (Ri, Gi, Bi) into those of a data format suitable for data processing in the linear conversion circuit 22, the color conversion circuit 23, the W generation circuit 24, and the gamma correction circuit 25, and outputs the results to the linear conversion circuit 22.

The linear conversion circuit 22 performs a linear conversion that is an inverse gamma correction to the input signals (Ri, Gi, Bi) received via the I/F control circuit 21. Specifically, because the input signals (Ri, Gi, Bi) have been gamma-corrected using a gamma value greater than 1 (for example, $\gamma=2.2$), the linear conversion circuit 22 converts (inverse-gamma corrects) the input signals (Ri, Gi, Bi) into RGB data obtained when the gamma value is 1. For example, when the input signals (Ri, Gi, Bi) are RGB data expressed by 8 bits (0 to 255), the linear conversion circuit 22 normalizes the RGB data so that R, G, and B components of the RGB data each have a value from 0 to 1 inclusive, and outputs the normalized RGB data to the color conversion circuit 23. The normalization processing on the RQB data described above is not necessarily needed. The inverse-gamma corrected data may be used as it is.

The color conversion circuit 23 performs the color conversion processing based on a first color conversion, an out-of-gamut correction, and a second color conversion (which are to be described later) to the normalized RGB data received from the linear conversion circuit 22 so as to generate RGB data (with component values of 0 to 1 inclusive) representing saturation values of colors that are reduced from those represented by the normalized RGB data, and outputs the generated RGB data to the W generation circuit 24.

Based on the RGB data received from the color conversion circuit 23, the W generation circuit 24 generates RGBW data including data of a W (white) component for driving the fourth sub-pixel 49W in the pixel 48, and the light source device control signal. The generation processing of the RGBW data and the light source device control signal based on the RGB data performed by the W generation circuit 24 can be achieved by a known method, such as that of JP-A-2008-176247 or Japanese Patent Application Laid-open Publication No. 2010-156817. The W generation circuit 24 outputs the generated RGBW data to the gamma correction circuit 25.

For example, when the input signals (Ri, Gi, Bi) are RGB data expressed by 8 bits (0 to 255) as described above, the gamma correction circuit 25 converts the RGBW data received from the W generation circuit 24 into 8-bit data, which is the same format as that of the input signals. Further, the gamma correction circuit 25 performs the gamma correction processing to the converted 8-bit data using the gamma value (for example, $\gamma=2.2$) for the input signals that have been gamma-corrected, and outputs the gamma-corrected RGBW data as the output signals (Ro, Go, Bo, Wo). A transmission amount of the light from the surface light source device 50 can be partially allocated to the fourth sub-pixel 49W of the pixel 48 based on the W (white) component of these output signals (Ro, Go, Bo, Wo), so that the transmittance of the entire color filter 36 increases, and thus the power consumption of the surface light source device 50 can be reduced. While the gamma correction circuit 25 converts the RGBW data into the 8-bit data, which is the same format as that of the input signals, the number of bits of the RGBW data need not coincide with that of the input signals.

The functions of the linear conversion circuit 22, the color conversion circuit 23, the W generation circuit 24, and the gamma correction circuit 25 may be implemented by hardware or software, and are not limited to be implemented by either. When each of the circuits of the signal processing unit 20 is configured by hardware, the circuits need not be physically distinguished as independent from each other, and the functions may be implemented by a physically single circuit.

1-4. Defined Color Gamut 111

Figure 5:
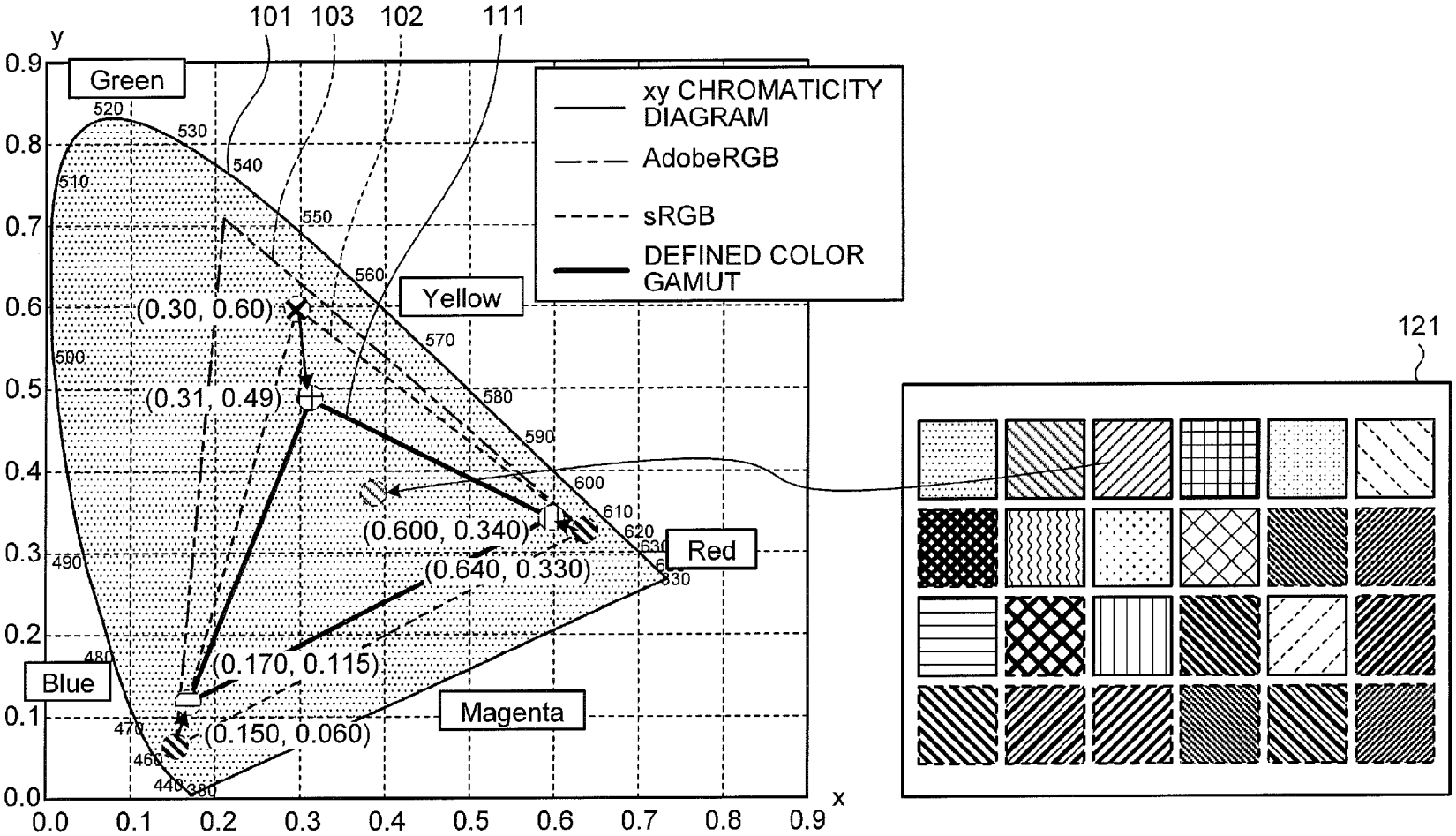
FIG. 5 is a diagram illustrating a defined color gamut in an sRGB color space in an XYZ color system.

FIG. 5 is a diagram illustrating a defined color gamut in an sRGB color space in an XYZ color system. With reference to FIG. 5, a detailed description will be made of this defined color gamut 111 in this sRGB color space 102 in the XYZ color space.

In a graph illustrated in FIG. 5, an xy chromaticity range 101 represents a range of colors in the XYZ color system considered to be distinguishable by the human naked eye. The XYZ color system is a representation form of colors that allows all colors distinguishable by the human naked eye to be expressed by positive numbers (X, Y, and Z). Putting $x=X/(X+Y+Z)$, $y=Y/(X+Y+Z)$, and $z=Z/(X+Y+Z)$, one obtains $x+y+z=1$, where x, y, and z represent ratios of X, Y, and Z, respectively, to the sum of X, Y, and Z. This leads to a relation $z=1-x-y$, so that determination of x and y determines z. This allows all colors to be expressed by only x and y, and the xy chromaticity range 101 is a range of x and y representing all colors in a coordinate system with x as the horizontal axis and y as the vertical axis. Specifically, a line surrounding the xy chromaticity range 101 (a line representing a border of the xy chromaticity range 101) and the inside of the surrounding line represent all colors, and a color defined by a point on the surrounding line represents monochromatic light (pure color). The hue of a color changes along the line surrounding the xy chromaticity range 101, and the saturation of a color decreases as the point moves inward the xy chromaticity range 101.

The numbers (X, Y, and Z) of the XYZ color system have one-to-one relations with values (R, G, and B) of the RGB data. Data conversion using a matrix can convert (X, Y, and Z) into (R, G, and B), or vice versa. As illustrated in FIG. 5, for illustrative purposes, the sRGB color space 102 and an Adobe (registered trademark) RGB color space 103 that are color spaces of the RGB data are illustrated in the xy chromaticity range 101 of the XYZ color system. The sRGB is an international standard of color space established by the International Electrotechnical Commission (IEC). The Adobe (registered trademark) RGB color space is a color space established by Adobe Systems.

In the liquid crystal display device 10 according to the present embodiment, the input signals (Ri, Gi, Bi) are RGB data represented by the inside of the sRGB color space 102. The signal processing unit 20 defines the defined color gamut 111 in the sRGB color space 102, and performs the color conversion processing to the color specified by the input signals (Ri, Gi, Bi) so as to convert the color into a color on a line surrounding the defined color gamut 111 (a line representing a border of the defined color gamut 111) or a color inside the defined color gamut 111. Samples of colors included in the sRGB color space 102 are arranged in a color sample array 121 illustrated in FIG. 5. In the color sample array 121, colors surrounded by dotted lines have higher saturation than that of colors surrounded by solid lines, and are not included in the colors on the line surrounding or inside the defined color gamut 111. As will be described later, the colors surrounded by the dotted lines are subjected to the above-described color conversion processing so as to be converted into colors on the line surrounding the defined color gamut 111.

The defined color gamut 111 is defined in the sRGB color space 102. However, not limited to this, the defined color gamut 111 may be defined in the Adobe (registered trademark) RGB color space 103 illustrated in FIG. 5, or any other color space. The sRGB color space 102 and the Adobe (registered trademark) color space 103 are indicated as triangular ranges in the xy chromaticity range 101 of the XYZ color system. However, the predetermined color space in which the defined color gamut is defined is not limited to be set as a triangular range, and may be set as a range of any shape, such as a polygonal shape, a circular shape, or an oval shape.

Figure 6:
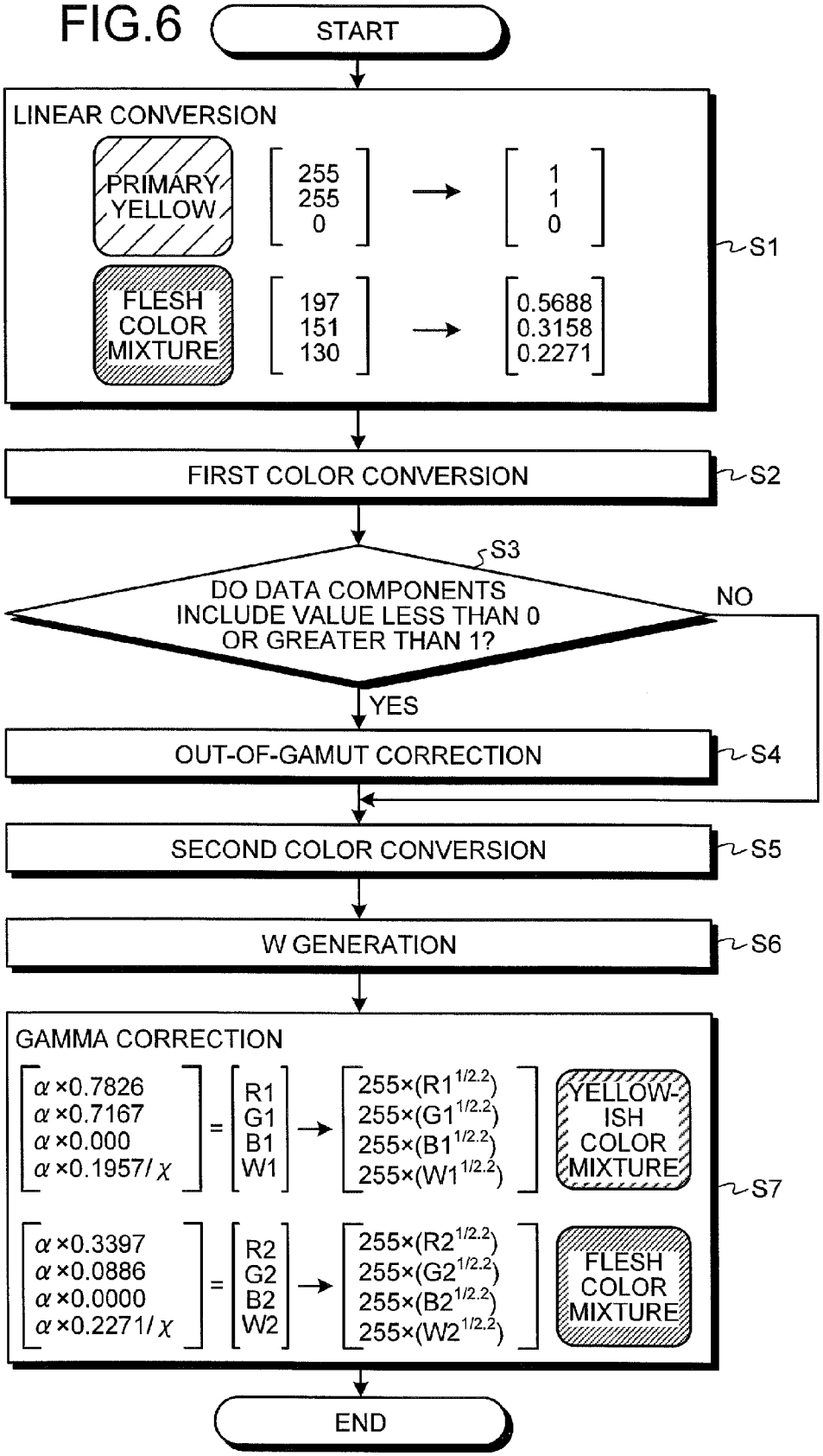
FIG. 6 is a flowchart illustrating operations of a linear conversion circuit, a color conversion circuit, and a gamma correction circuit of the liquid crystal display device according to the first embodiment of the present disclosure.

1-5. Operations of Linear Conversion, Color Conversion Processing, and Gamma Correction FIG. 6 is a flowchart illustrating operations of the linear conversion circuit, the color conversion circuit, and the gamma correction circuit of the liquid crystal display device according to the present embodiment of the present disclosure. With reference to FIG. 6, descriptions will be made of specific operations of the linear conversion, the color conversion processing, the four-color generation processing, and the gamma correction by the linear conversion circuit 22, the color conversion circuit 23, the W generation circuit 24, and the gamma correction circuit 25.

1-5-1. Specific Example (Primary Yellow)

First, a description will be made of an example of performing the color conversion processing to a color that is primary yellow having higher saturation than that of a flesh color mixture (to be described later) and that is expressed to be (255, 255, 0) as 8-bit RGB data.

Step S1

The linear conversion circuit 22 performs the linear conversion serving as the inverse gamma correction to the input signals (Ri, Gi, Bi)=(255, 255, 0), and further normalizes the linear-converted values so as to obtain values each being 0 to 1 inclusive, thus deriving (1, 1, 0). The linear conversion circuit 22 outputs the normalized RGB data (1, 1, 0) to the color conversion circuit 23. Specifically, for example, Ri (=255) that is the R component of the input signals is linear-converted by Equation (1) below. In Equation (1), a is a value (0 to 255) before the linear conversion; b is a value (0 to 255) after the linear conversion; and γ is the gamma value (γ=2.2 here) for the gamma-corrected input signals.

$$b=255*(a/255)^{\gamma}=255*(255/255)^{2.2} \quad (1)$$

Further, normalization of b obtained by Equation (1) results in "1" that is the R component of the normalized RGB data. The linear conversion circuit 22 performs liner-conversion and normalization to the G and B components of the input signals by the same calculations. Then, the process proceeds to Step S2.

The input signals are linear-converted and then normalized as described above. However, not limited to this sequence, the input signals may be normalized and then linear-converted. Both sequences result in the same values.

Performing of the inverse gamma correction processing to the input signals in this manner can return the input signals that have been gamma-corrected depending on how the image looks on a display device to original image data before the gamma correction, and thus enables appropriate data processing.

Step S2

As expressed by Equation (2) below, the first color conversion circuit 23A of the color conversion circuit 23 performs the first color conversion of multiplying the RGB data (1, 1, 0) received from the linear conversion circuit 22 by a matrix M1 (first matrix), and thereby derives, for example, (0.9967, 1.1265, −0.2718) as defined color gamut determination data. As will be described later, the matrix M1 is used for performing arithmetic processing to the RGB data output from the linear conversion circuit 22 so as to determine whether the color specified by the input signals (Ri, Gi, Bi) is on the line surrounding or inside the defined color gamut 111. Changing the shape of the defined color gamut 111 in the sRGB color space 102 changes values of matrix elements of the Matrix M1.

Matrix $M1$ $$\begin{bmatrix} 1.3155 & -0.3188 & 0.0034 \\ -0.0471 & 1.1736 & -0.1265 \\ -0.0142 & -0.2576 & 1.2718 \end{bmatrix} * \begin{bmatrix} 1 \\ 1 \\ 0 \end{bmatrix} = \begin{bmatrix} 0.9967 \\ 1.1265 \\ -0.2718 \end{bmatrix} \quad (2)$$

The first color conversion circuit 23A outputs the derived defined color gamut determination data to the out-of-gamut correction circuit 23B. Then, the process proceeds to Step S3.

Step S3

The out-of-gamut correction circuit 23B of the color conversion circuit 23 determines whether components of the defined color gamut determination data received from the first color conversion circuit 23A include a value less than 0 or greater than 1. This determination can determine whether the color specified by the input signals (Ri, Gi, Bi) is on the line surrounding or inside the defined color gamut 111. Specifically, if the determination result indicates that the components of the defined color gamut determination data include a value less than 0 or greater than 1, the out-of-gamut correction circuit 23B determines that the color specified by the input signals (Ri, Gi, Bi) is outside the defined color gamut 111, and the process proceeds to Step S4. If, instead, the components of the defined color gamut determination data do not include a value less than 0 or greater than 1, the out-of-gamut correction circuit 23B determines that the color specified by the input signals (Ri, Gi, Bi) is on the line surrounding or inside the defined color gamut 111, and outputs the defined color gamut determination data without change as correction data to the second color conversion circuit 23C. Then, the process proceeds to Step S5. When the defined color gamut determination data is (0.9967, 1.1265, −0.2718), the components thereof include a value less than 0 or greater than 1. Accordingly, the out-of-gamut correction circuit 23B determines that the color specified by the input signals is outside the defined color gamut 111, and the process proceeds to Step S4.

Step S4

The out-of-gamut correction circuit 23B of the color conversion circuit 23 performs the processing of the out-of-gamut correction to replace data less than 0 with "0" and data greater than 1 with "1" among the components of the defined color gamut determination data. When the defined color gamut determination data is (0.9967, 1.1265, −0.2718), the out-of-gamut correction circuit 23B performs the out-of-gamut correction to derive correction data (0.9967, 1, 0), and outputs the correction data to the second color conversion circuit 23C. Then, the process proceeds to Step S5.

Step S5

As expressed by Equation (3) below, the second color conversion circuit 23C of the color conversion circuit 23 performs the second color conversion of multiplying the correction data (0.9967, 1, 0) received from the out-of-gamut correction circuit 23B by a matrix M2 (second matrix), and thereby derives in-defined-gamut data (0.9783, 0.9124, 0.1957). The matrix M2 is the inverse matrix of the matrix M1.

Matrix $M2$ $$\begin{bmatrix} 0.7680 & 0.2128 & 0.0191 \\ 0.0325 & 0.8801 & 0.0875 \\ 0.0151 & 0.1806 & 0.8042 \end{bmatrix} * \begin{bmatrix} 0.9967 \\ 1 \\ 0 \end{bmatrix} = \begin{bmatrix} 0.9783 \\ 0.9124 \\ 0.1957 \end{bmatrix} \quad (3)$$

Performing of the second color conversion as described above can convert the color specified by the RGB data linear-converted and normalized at Step S1 into the color on the line surrounding the defined color gamut 111 without changing the hue thereof. The second color conversion circuit 23C outputs the derived in-defined-gamut data to the W generation circuit 24. Then, the process proceeds to Step S6.

Step S6

The W generation circuit 24 converts the RGB data (in-defined-gamut data) received from the second color conversion circuit 23C into RGBW data. For example, the W generation circuit 24 extracts a component having the smallest value in the RGB data received from the second color conversion circuit 23C, and sets values obtained by subtracting the value of the extracted component from all values of the RGB data as new RGB data. Among components of the new data RGB data, the component corresponding to the above-mentioned extracted component results in "0". The value of the W component is obtained by dividing the value of the extracted component by a coefficient $\chi$. Further, the W generation circuit 24 multiplies the components of the RGBW data thus obtained by an expansion coefficient $\alpha$ to obtain values as new RGBW data. The coefficient $\chi$ is a ratio of the maximum brightness of the fourth sub-pixel 49W to the maximum brightness of a set of the first, the second, and the third sub-pixels 49R, 49G, and 49B. The coefficient $\alpha$ is a value of 1 or greater obtained from the coefficient $\chi$ and the RGB data received from the second color conversion circuit 23C, and is a coefficient that can increase the values by amounts allocable to the W component. Specifically, based on the RGB data (in-defined-gamut data) (0.9783, 0.9124, 0.1957) received from the second color conversion circuit 23C, the W generation circuit 24 generates RGBW data ($\alpha$*0.7826, $\alpha$*0.7167, $\alpha$*0.0000, $\alpha$*0.1957/$\chi$) (=(R1, G1, B1, W1)).

Step S7

The gamma correction circuit 25 performs the gamma correction to the RGBW data received from the W generation circuit 24, and quantizes the gamma-corrected values into values 0 to 255 for data processing. Specifically, for example, ($\alpha$*0.7826) that is the R component of the in-defined-gamut data is gamma-corrected by Equation (4) below. In Equation (4), c is a value before the gamma correction; d is a value after the gamma correction; and $\gamma$ is the gamma value ($\gamma$=2.2 here).

$$d=c^{1/\gamma}=(\alpha*0.7826)^{1/2.2} \quad (4)$$

The quantization of d obtained by Equation (4) into a value 0 to 255 results in $[255*(R1^{1/2.2})]$ that is the R component of the quantized RGBW data. The gamma correction circuit 25 gamma-corrects and quantizes the G, B, and W components of the RGBW data by performing the same calculations, and derives RGBW data ($255*(R1^{1/2.2})$, $255*(G1^{1/2.2})$, $255*(B1^{1/2.2})$, $255*(W1^{1/2.2})$) (yellowish color mixture).

The RGBW data is gamma-corrected and then quantized as described above. However, not limited to this sequence, the RGBW data may be quantized and then gamma-corrected. Both sequences result in the same values.

Performing of the gamma correction processing in this manner can approximately linearize display characteristics as a relation between the RGBW data and brightness of the display screen in the display device.

The procedure of the color conversion processing as described above can convert the color specified by the input signals using the first color conversion into the color on the line surrounding the defined color gamut 111.

1-5-2. Specific Example (Flesh Color Mixture)

A description will be made of an example of performing the color conversion processing to a color that is the flesh color mixture having lower saturation than that of the above-mentioned primary yellow and is represented by (197, 151, 130) as RGB data (8-bit data).

Step S1

The linear conversion circuit 22 performs the linear conversion serving as the inverse gamma correction to the input signals (Ri, Gi, Bi)=(197, 151, 130), and further normalizes the linear-converted values so as to obtain values each being 0 to 1 inclusive, thus deriving (0.5668, 0.3158, 0.2271). The linear conversion circuit 22 outputs the normalized RGB data (0.5668, 0.3158, 0.2271) to the color conversion circuit 23. Specifically, for example, Ri (=197) that is the R component of the input signals is linear-converted by Equation (5) below.

$$b=255*(a/255)^{\gamma}=255*(197/255)^{2.2} \quad (5)$$

Further, normalization of b obtained by Equation (5) results in "0.5668" that is the R component of the normalized RGB data. The linear conversion circuit 22 performs liner-conversion and normalization to the G and B components of the input signals by the same calculations. Then, the process proceeds to Step S2.

Step S2

As expressed by Equation (6) below, the first color conversion circuit 23A of the color conversion circuit 23 performs the first color conversion of multiplying the RGB data (0.5668, 0.3158, 0.2271) received from the linear conversion circuit 22 by a matrix M1, and thereby derives defined color gamut determination data (0.6457, 0.3152, 0.1994).

Matrix $M1$ $$\begin{bmatrix} 1.3155 & -0.3188 & 0.0034 \\ -0.0471 & 1.1736 & -0.1265 \\ -0.0142 & -0.2576 & 1.2718 \end{bmatrix} * \begin{bmatrix} 0.5668 \\ 0.3158 \\ 0.2271 \end{bmatrix} = \begin{bmatrix} 0.6457 \\ 0.3152 \\ 0.1994 \end{bmatrix} \quad (6)$$

The first color conversion circuit 23A outputs the derived defined color gamut determination data to the out-of-gamut correction circuit 23B. Then, the process proceeds to Step S3.

Step S3

The out-of-gamut correction circuit 23B of the color conversion circuit 23 determines whether components of the defined color gamut determination data received from the first color conversion circuit 23A include a value less than 0 or greater than 1. This determination can determine whether the color specified by the input signals (Ri, Gi, Bi) is on the line surrounding or inside the defined color gamut 111. Specifically, if the determination result indicates that the components of the defined color gamut determination data include a value less than 0 or greater than 1, the out-of-gamut correction circuit 23B determines that the color specified by the input signals (Ri, Gi, Bi) is outside the defined color gamut 111, and the process proceeds to Step S4. If, instead, the components of the defined color gamut determination data do not include a value less than 0 or greater than 1, the out-of-gamut correction circuit 23B determines that the color specified by the input signals (Ri, Gi, Si) is on the line surrounding or inside the defined color gamut 111, and outputs the defined color gamut determination data without change as correction data to the second color conversion circuit 23C. Then, the process proceeds to Step S5. In the case of the defined color gamut determination data (0.6457, 0.3152, 0.1994), the components thereof include neither a value less than 0 nor a value greater than 1. Accordingly, the out-of-gamut correction circuit 23B determines that the color specified by the input signals is on the line surrounding or inside the defined color gamut 111, and the process proceeds to Step S5.

Step S5

As expressed by Equation (7) below, the second color conversion circuit 23C of the color conversion circuit 23 performs the second color conversion of multiplying the correction data (0.6457, 0.3152, 0.1994) received from the out-of-gamut correction circuit 23B by the matrix M2 that is the inverse matrix of the matrix M1, and thus derives in-defined-gamut data (0.5668, 0.3158, 0.2271).

Matrix $M2$ $$\begin{bmatrix} 0.7680 & 0.2128 & 0.0191 \\ 0.0325 & 0.8801 & 0.0875 \\ 0.0151 & 0.1806 & 0.8042 \end{bmatrix} * \begin{bmatrix} 0.6457 \\ 0.3152 \\ 0.1994 \end{bmatrix} = \begin{bmatrix} 0.5668 \\ 0.3158 \\ 0.2271 \end{bmatrix} \quad (7)$$

The second color conversion performed by the second color conversion circuit 23C as described above provides the in-defined-gamut data (0.5668, 0.3158, 0.2271) that is equal to the RGB data (0.5668, 0.3158, 0.2271) linear-converted and normalized at Step S1. This means that, if a color specified by input signals (Ri, Gi, Bi) is determined at Step 3 to be on the line surrounding or inside the defined color gamut 111, the color is maintained to be the color on the line surrounding or inside the defined color gamut 111 without being converted by the color conversion processing. The second color conversion circuit 23C outputs the derived in-defined-gamut data to the W generation circuit 24. Then, the process proceeds to Step S6.

Step S6

The W generation circuit 24 converts the RGB data (in-defined-gamut data) received from the second color conversion circuit 23C into RGBW data. For example, the W generation circuit 24 extracts a component having the smallest value in the RGB data received from the second color conversion circuit 23C, and sets values obtained by subtracting the value of the extracted component from all values of the RGB data as new RGB data. Among components of the new data RGB data, the component corresponding to the above-mentioned extracted component results in "0". The value of the W component is obtained by dividing the value of the extracted component by the coefficient $\chi$. Further, the W generation circuit 24 multiplies the components of the RGBW data thus obtained by the expansion coefficient $\alpha$ to obtain values as new RGBW data. Specifically, based on the RGB data (in-defined-gamut data) (0.5668, 0.3158, 0.2271) received from the second color conversion circuit 23C, the W generation circuit 24 generates RGBW data ($\alpha$*0.3397, $\alpha$*0.0886, $\alpha$*0.0000, $\alpha$*0.2271/$\chi$) (=(R2, G2, B2, W2)).

Step S7

The gamma correction circuit 25 performs the gamma correction to the RGBW data received from the W generation circuit 24, and quantizes the gamma-corrected values into values 0 to 255 for data processing. Specifically, for example, ($\alpha$*0.3397) that is the R component of the in-defined-gamut data is gamma-corrected by Equation (8) below.

$$d=c^{1/\gamma}=(\alpha*0.3397)^{1/2.2} \quad (8)$$

The quantization of d obtained by Equation (8) into a value 0 to 255 results in [255*($R2^{1/2.2}$)] that is the R component of the quantized RGBW data. The gamma correction circuit 25 gamma-corrects and quantizes the G, B, and W components of the RGBW data by performing the same calculations, and derives RGBW data (255*($R2^{1/2.2}$), 255*($G2^{1/2.2}$), 255*($32^{1/2.2}$), 255*($W2^{1/2.2}$)) (flesh color mixture).

The color conversion processing as described above first determines whether a color specified by input signals is on the line surrounding or inside the defined color gamut 111 defined in the predetermined color space (here, the sRGB color space 102). If the color specified by the input signals is determined to be outside the defined color gamut 111, the color is converted into a color on the line surrounding the defined color gamut 111, that is, color-converted in the direction of decreasing in saturation, without being changed in hue. If the color specified by the input signals is determined to be on the line surrounding or inside the defined color gamut 111, the color is not converted and is maintained to be the color on the line surrounding or inside the defined color gamut 111. Accordingly, the color conversion is applied only to colors outside the defined color gamut 111 that have higher saturation than that of colors on the line surrounding or inside the defined color gamut 111, and can convert the colors outside the defined color gamut 111 into colors on the line surrounding the defined color gamut 111 without changing the hue thereof. The display quality deterioration due to reduction in saturation of an image can be suppressed more than the case of reducing the saturation of all colors of the image. In addition, all colors of the image can be concentrated into those on the line surrounding or inside the defined color gamut 111. Thus, the concentration of all colors into those on the line surrounding or inside the defined color gamut 111 increases the portion of the transmission amount of the light from the surface light source device 50 that is allocable to the fourth sub-pixel 49W of the pixel 48. This increases the transmittance of the entire color filter 36, and thus can reduce the power consumption of the surface light source device 50.

At Step S4 described above, the out-of-gamut correction circuit 23B performs the processing of the out-of-gamut correction in which, among the components of the defined color gamut determination data, data less than 0 is replaced with "0", and data greater than 1 is replaced with "1". However, the out-of-gamut correction is not limited to this. That is, the out-of-gamut correction circuit 23B may perform the out-of-gamut correction in which the data less than 0 and the data greater than 1 among the components of the defined color gamut determination data are replaced with data from 0 to 1 inclusive, within a range in which a change in hue falls within a predetermined amount. By replacing the data with data from 0 to 1 inclusive as described above, the second color conversion at Step S5 described above can convert the color specified by the RGB data linear-converted and normalized at Step S1 into a color on the line surrounding or inside the defined color gamut 111, within a range in which a change in hue falls within the predetermined amount.

The defined color gamut 111 defined in the predetermined color space (sRGB color space 102 in FIG. 5) is illustrated as the triangular range. However, not limited to this, the defined color gamut 111 may be set as a range of any shape, such as a polygonal shape, a circular shape, or an oval shape. In this case, to determine whether the color specified by the input signals (Ri, Gi, Bi) is on the line surrounding or inside the defined color gamut 111, arithmetic processing other than matrix operations needs to applied to the RGB data output from the linear conversion circuit 22, in accordance with the shape of the defined color gamut 111.

2. Second Embodiment

Configuration of Electronic Apparatus 200

Figure 7:
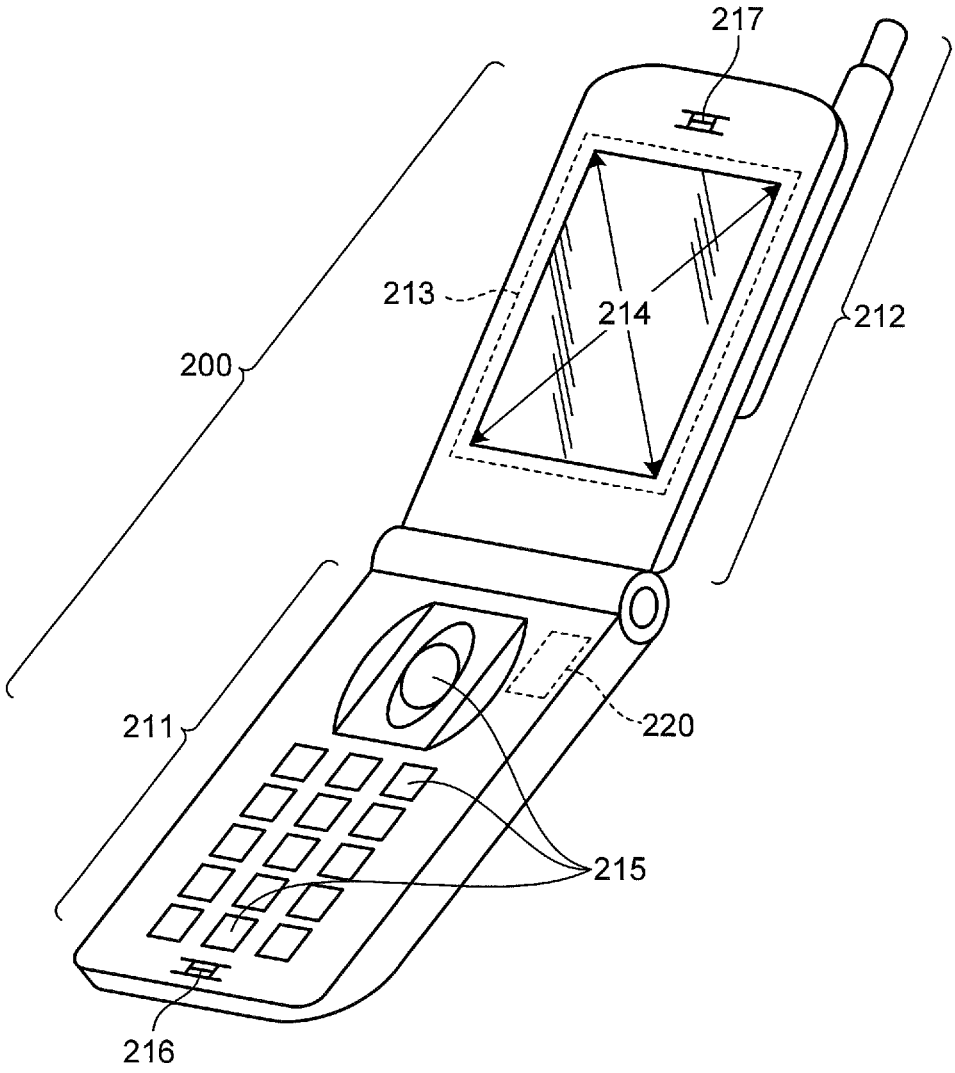
FIG. 7 is an external view of an electronic apparatus according to a second embodiment of the present disclosure.

FIG. 7 is an external view of an electronic apparatus according to a second embodiment of the present disclosure. FIG. 7 illustrates a mobile phone as an example of an electronic apparatus 200. A configuration of the electronic apparatus 200 according to the present embodiment will be described with reference to FIG. 7.

The electronic apparatus 200 is the mobile phone as described above, and includes a main body portion 211 and a display body portion 212 provided in an openable and closable manner on the main body portion 211 as illustrated in FIG. 7.

The main body portion 211 includes operation buttons 215, a transmission part 216, and a control device 220. The display body portion 212 includes a liquid crystal display device 213 and a receiving part 217.

The liquid crystal display device 213 displays various types of information on telephone communications on a display screen 214 of the liquid crystal display device 213. The liquid crystal display device 213 is composed of the liquid crystal display device 10 according to the first embodiment.

A user operates the operation buttons 215, whose operation signals are transmitted to the control device 220.

Based on, for example, the operation signals received from the operation buttons 215, the control device 220 determines an image to be displayed on the display screen 214 of the liquid crystal display device 213, and transmits RGB data of the image as input signals to the liquid crystal display device 213.

The liquid crystal display device 213 performs the linear conversion, the color conversion processing, and the gamma correction which have been described in detail in the first embodiment to the input signals received from the control device 220, and generates output signals and a light source device control signal based on the RGB data to which these processes have been applied. Based on the output signals and the light source device control signal, the liquid crystal display device 213 displays the image on the display screen 214.

The liquid crystal display device 213 may be configured to be capable of selecting whether to perform the linear conversion, the color conversion processing, and the gamma correction to the input signals received from the control device 220 based on setting information held by the control device 220. The control device 220 may be configured to hold several defined color gamuts 111 for performing the color conversion processing, and to be capable of selecting one as appropriate. These configurations allow the electronic apparatus 200 to select whether to perform the linear conversion, the color conversion processing, and the gamma correction, and when performing them, to select an appropriate defined color gamut 111 from the several defined color gamuts 111, according to the environment in which the electronic apparatus 200 is placed.

As described above, constituting the liquid crystal display device 213 of the electronic apparatus 200 by the liquid crystal display device 10 according to the first embodiment can suppress the display quality deterioration due to reduction in saturation of an image, and can reduce the power consumption.

Examples of the electronic apparatus 200 according to the present embodiment to which the liquid crystal display device 10 according to the first embodiment can be applied include, in addition to the above-described mobile phone, a clock with a display device, a watch with a display device, a personal computer, a liquid crystal television, video tape recorders of viewfinder type and monitor direct view type, a vehicle navigation device, a pager, an electronic organizer, an electronic calculator, a word processor, a workstation, a videophone, and a point-of-sale (POS) terminal.

The embodiments of the present disclosure are not limited by the foregoing descriptions. Further, the components in the above described embodiments may include components easily conceivable by those skilled in the art and components substantially identical, in other words, components that are within the range of equivalency. Moreover, various omissions, alternatives and variations of the components may be possible within the scope of the above embodiment.

3. Aspects of Present Disclosure

The present disclosure includes the following aspects.

(1). A color conversion device comprising:

a signal processing unit that generates output signals to control operations of pixels of a display unit based on input signals input from outside; and a signal output unit that outputs driving signals of the pixels based on the output signals generated by the signal processing unit, wherein when a color specified in a predetermined color space by color data based on the input signals is a color outside a defined color gamut defined in the color space, the signal processing unit generates in-defined-gamut data that specifies a color on a border of or inside the defined color gamut, when the color specified in the color space by the color data based on the input signals is a color on the border of or inside the defined color gamut, the signal processing unit does not convert the color data based on the input signals into color data of a color different from that specified by the color data based on the input signals, and generates in-defined-gamut data identical to the color data based on the input signals, and the signal processing unit generates the output signals based on the in-defined-gamut data.

(2). A display device comprising:

a display unit in which the pixels are arranged in a two-dimensional matrix; and a color conversion device, wherein the color conversion device includes a signal processing unit that generates output signals to control operations of pixels of the display unit based on input signals input from outside, and a signal output unit that outputs driving signals of the pixels based on the output signals generated by the signal processing unit, wherein when a color specified in a predetermined color space by color data based on the input signals is a color outside a defined color gamut defined in the color space, the signal processing unit generates in-defined-gamut data that specifies a color on a border of or inside the defined color gamut, when the color specified in the color space by the color data based on the input signals is a color on the border of or inside the defined color gamut, the signal processing unit does not convert the color data based on the input signals into color data of a color different from that specified by the color data based on the input signals, and generates in-defined-gamut data identical to the color data based on the input signals, and the signal processing unit generates the output signals based on the in-defined-gamut data.

(3). The display device according to (2), wherein the signal processing unit comprises:

a first color conversion unit that generates defined color gamut determination data for determining, based on the color data based on the input signals, whether the color specified by the color data is a color on the border of or inside the defined color gamut;

an out-of-gamut correction unit that determines, based on the defined color gamut determination data generated by the first color conversion unit, whether the color specified by the color data based on the input signals is a color on the border of or inside the defined color gamut, generates correction data by correcting the defined color gamut determination data so that the color is determined to be a color on the border of or inside the defined color gamut when the specified color is determined to be a color outside the defined color gamut, and generates correction data identical to the defined color gamut determination data without change when the specified color is determined to be a color on the border of or inside the defined color gamut; and a second color conversion unit that generates, based on the correction data generated by the out-of-gamut correction unit, the in-defined-gamut data that specifies the color on the border of or inside the defined color gamut.

(4). The display device according to (3), wherein the first color conversion unit generates the defined color gamut determination data by multiplying the color data based on the input signals by a predetermined first matrix; and the second color conversion unit generates the in-defined-gamut data by multiplying the correction data by a second matrix that is the inverse matrix of the first matrix.

(5). The display device according to (2), wherein, if the color specified by the color data based on the input signals is a color outside the defined color gamut, the signal processing unit generates the in-defined-gamut data that specifies a color on the border of the defined color gamut.

(6). The display device according to (2), further comprising:

a surface light source device that is disposed on the back side opposite to an image display surface of the display unit, and emits white light toward a substantially entire surface of the display unit; and a light source device control unit that controls the surface light source device, wherein the pixels of the display unit each comprise a first sub-pixel displaying a first color, a second sub-pixel displaying a second color, a third sub-pixel displaying a third color, and a fourth sub-pixel displaying white;

the signal processing unit comprises a four-color generation unit that generates the output signals and a light source device control signal based on the in-defined-gamut data;

the signal output unit outputs the driving signals to the first sub-pixels, the second sub-pixels, the third sub-pixels, and the fourth sub-pixels based on the output signals generated by the four-color generation unit; and the light source device control unit outputs, based on the light source device control signal generated by the four-color generation unit, a driving voltage to make the surface light source device emit the white light.

(7). The display device according to (2), wherein the signal processing unit comprises:

a linear conversion unit that converts the input signals that have been gamma-corrected into data before being gamma-corrected; and a gamma correction unit that gamma-corrects the in-defined-gamut data, and the signal processing unit generates the output signals based on the in-defined-gamut data that is gamma-corrected by the gamma correction unit using the data converted by the linear conversion unit as the color data based on the input signals.

(8). A color conversion method comprising:

performing a first color conversion of generating defined color gamut determination data for determining, based on color data based on input signals, whether a color specified by the color data is a color on a border of or inside a defined color gamut defined in a predetermined color space;

determining, based on the defined color gamut determination data, whether the color specified by the color data based on the input signals is a color on the border of or inside the defined color gamut;

generating correction data by correcting the defined color gamut determination data so that the color is determined to be a color on the border of or inside the defined color gamut when the specified color is determined to be a color outside the defined color gamut at the determining, and generating correction data by using the defined color gamut determination data without change when the specified color is determined to be a color on the border of or inside the defined color gamut at the determining; and performing a second color conversion of generating, based on the correction data, the in-defined-gamut data that specifies the color on the border of or inside the defined color gamut.

(9). The color conversion method according to (8), further comprising generating, based on the in-defined-gamut data, output signals to control operations of first sub-pixels, second sub-pixels, third sub-pixels, and fourth sub-pixels comprised in pixels arranged in a display unit.

A color conversion device, a display device, an electronic apparatus, and a color conversion method according to the present disclosure perform color conversion only to colors outside a defined color gamut that have higher saturation than that of colors on the border of or inside the defined color gamut, and can convert the colors outside the defined color gamut into colors on the border of or inside the defined color gamut without changing the hue thereof. This conversion can suppress display quality deterioration due to reduction in saturation of an image more than a case of reducing the saturation of all colors of the image.

What is claimed is:

1. A color conversion device comprising:

a signal processor configured to generate output signals to control operations of pixels of display circuitry based on input signals; and signal output circuitry that outputs driving signals of the pixels based on the output signals generated by the signal processor, wherein the signal processor comprises:

linear conversion circuitry that converts an input signal that has been gamma-corrected into data before being gamma-corrected to generate color data based on the input signal;

first color conversion circuitry that generates defined color gamut determination data for determining whether a color specified in a predetermined color space by the color data based on the input signal is a color on a border of or inside a defined color gamut defined in the predetermined color space, by multiplying the color data based on the input signal by a first matrix;

out-of-gamut correction circuitry that generates correction data based on the defined color gamut determination data generated by the first color conversion circuitry;

second color conversion circuitry generating in-defined-gamut data that specifies a color on the border of or inside the defined color gamut, by multiplying the correction data by a second matrix that is an inverse matrix of the first matrix; and gamma correction circuitry that gamma-corrects the in-defined-gamut data to generate an output signal, wherein the first matrix is a matrix for converting a value included in the color data based on the input signal into one of a value from a first threshold to a second threshold, a value smaller than the first threshold, and a value greater than the second threshold, depending on a position relation of the color data to the defined color gamut, wherein, when the defined color gamut determination data comprises at least one of a value less than the first threshold and a value greater than the second threshold, the out-of-gamut correction circuitry determines that the color specified by the color data based on the input signal is a color outside the defined color gamut, and generates correction data by correcting the defined color gamut determination data so that a value less than the first threshold is replaced with the first threshold and so that a value greater than the second threshold is replaced with the second threshold, and wherein, when the defined color gamut determination data does not comprise a value less than the first threshold and a value greater than the second threshold, the out-of-gamut correction circuitry determines that the color specified by the color data based on the input signal is a color on the border of or inside the defined color gamut, and generates correction data identical to the defined color gamut determination data without change.

2. The color conversion device according to claim 1, wherein the first matrix comprises a value that is defined according to a shape of the defined color gamut in the predetermined color space.

3. A display device comprising:

display circuitry in which pixels are arranged in a two-dimensional matrix; and a color conversion device, wherein the color conversion device comprises:

a signal processor that generates output signals to control operations of the pixels of the display circuitry based on input signals, and signal output circuitry that outputs driving signals of the pixels based on the output signals generated by the signal processor, wherein the signal processor comprises:

linear conversion circuitry that converts an input signal that has been gamma-corrected into data before being gamma-corrected to generate color data based on the input signal;

first color conversion circuitry that generates defined color gamut determination data for determining whether a color specified in a predetermined color space by the color data based on the input signal is a color on a border of or inside a defined color gamut defined in the predetermined color space, by multiplying the color data based on the input signal by a first matrix;

out-of-gamut correction circuitry that generates correction data based on the defined color gamut determination data generated by the first color conversion circuitry;

second color conversion circuitry generating in-defined-gamut data that specifies a color on the border of or inside the defined color gamut, by multiplying the correction data by a second matrix that is an inverse matrix of the first matrix; and gamma correction circuitry that gamma-corrects the in-defined-gamut data to generate an output signal, wherein the first matrix is a matrix for converting a value included in the color data based on the input signal into one of a value from a first threshold to a second threshold, a value smaller than the first threshold, and a value greater than the second threshold, depending on a position relation of the color data to the defined color gamut, wherein, when the defined color gamut determination data comprises at least one of a value less than the first threshold and a value greater than the second threshold, the out-of-gamut correction circuitry determines that the color specified by the color data based on the input signal is a color outside the defined color gamut, and generates correction data by correcting the defined color gamut determination data so that a value less than the first threshold is replaced with the first threshold and so that a value greater than the second threshold is replaced with the second threshold, and wherein, when the defined color gamut determination data does not comprise a value less than the first threshold and a value greater than the second threshold, the out-of-gamut correction circuitry determines that the color specified by the color data based on the input signal is a color on the border of or inside the defined color gamut, and generates correction data identical to the defined color gamut determination data without change.

4. The display device according to claim 3, wherein, when the color specified by the color data based on the input signal is a color outside the defined color gamut, the signal processor generates the in-defined-gamut data that specifies a color on the border of the defined color gamut.

5. The display device according to claim 3, further comprising:

a surface light source device that is disposed on the back side opposite to an image display surface of the display circuitry, and emits white light toward a substantially entire surface of the display circuitry; and light source device control circuitry that controls the surface light source device, wherein the pixels of the display circuitry each comprise a first sub-pixel displaying a first color, a second sub-pixel displaying a second color, a third sub-pixel displaying a third color, and a fourth sub-pixel displaying white;

the signal processor comprises a four-color generation circuitry that generates in-defined-gamut data including components of the first color, the second color, the third color, and white and a light source device control signal based on the in-defined-gamut data generated by the second color conversion circuitry;

the gamma correction circuitry gamma-corrects the in-defined-gamut data including the components of the first color, the second color, the third color, and white to generate the output signal;

the signal output circuitry outputs the driving signals to the first sub-pixels, the second sub-pixels, the third sub-pixels, and the fourth sub-pixels based on the output signal generated by the gamma correction circuitry; and the light source device control circuitry outputs, based on the light source device control signal generated by the four-color generation circuitry, a driving voltage to make the surface light source device emit the white light.

6. The display device according to claim 3, wherein the first matrix comprises a value that is defined according to a shape of the defined color gamut in the predetermined color space.

7. A color conversion method comprising:

performing a first color conversion of generating defined color gamut determination data for determining whether a color specified by color data based on an input signal is a color on a border of or inside a defined color gamut defined in a predetermined color space, by multiplying the color data based on the input signal in the predetermined color space by a first matrix;

determining, based on the defined color gamut determination data, whether the color specified by the color data based on the input signal is a color on the border of or inside the defined color gamut;

generating correction data based on a determination result by the determining; and performing a second color conversion of generating the in-defined-gamut data that specifies the color on the border of or inside the defined color gamut by multiplying the correction data by a second matrix that is an inverse matrix of the first matrix, wherein the first matrix is a matrix for converting a value included in the color data based on the input signal into one of a value from a first threshold to a second threshold, a value smaller than the first threshold, and a value greater than the second threshold, depending on a position relation of the color data to the defined color gamut, wherein, when the defined color gamut determination data comprises at least one of a value less than the first threshold and a value greater than the second threshold, the determining determines that the color specified by the color data based on the input signal is a color outside the defined color gamut, and the generating correction data generates correction data by correcting the defined color gamut determination data so that a value less than the first threshold is replaced with the first threshold and so that a value greater than the second threshold is replaced with the second threshold, and wherein, when the defined color gamut determination data does not comprise a value less than the first threshold and a value greater than the second threshold, the determining determines that the color specified by the color data based on the input signal is a color on the border of or inside the defined color gamut, and the generating correction data generates correction data identical to the defined color gamut determination data without change.

8. The color conversion method according to claim 7, further comprising generating, based on the in-defined-gamut data, output signals to control operations of first sub-pixels, second sub-pixels, third sub-pixels, and fourth sub-pixels comprised in pixels arranged in a display circuitry.

9. The color conversion method according to claim 7, wherein the first matrix comprises a value that is defined according to a shape of the defined color gamut in the predetermined color space.

10. A color conversion device comprising:

a signal processor configured to generate output signals to control operations of pixels of display circuitry based on input signals; and signal output circuit that outputs driving signals of the pixels based on the output signals generated by the signal processor, wherein the signal processor comprises:

linear conversion circuitry that converts an input signal that has been gamma-corrected into data before being gamma-corrected to generate color data based on the input signal;

color conversion circuitry that generates in-defined-gamut data that specifies a color on the border of or inside a defined color gamut defined in a predetermined color space based on the color data based on the input signal; and gamma correction circuitry that gamma-corrects the in-defined-gamut data to generate an output signal, and wherein the first matrix is a matrix for converting a value included in the color data based on the input signal into one of a value from a first threshold to a second threshold, a value smaller than the first threshold, and a value greater than the second threshold, depending on a position relation of the color data to the defined color gamut, wherein, when the defined color gamut determination data comprises at least one of a value less than the first threshold and a value greater than the second threshold, the color conversion circuitry determines that the color specified by the color data based on the input signal is a color outside the defined color gamut, and generates correction data by correcting the defined color gamut determination data so that a value less than the first threshold is replaced with the first threshold and so that a value greater than the second threshold is replaced with the second threshold, wherein, when the defined color gamut determination data does not comprise a value less than the first threshold and a value greater than the second threshold, the color conversion circuitry determines that the color specified by the color data based on the input signal is a color on the border of or inside the defined color gamut, and generates correction data identical to the defined color gamut determination data without change, and wherein the color conversion circuitry multiplies the correction data by a second matrix that is an inverse matrix of the first matrix to generate the in-defined-gamut data.

11. The color conversion device according to claim 10, wherein the first matrix comprises a value that is defined according to a shape of the defined color gamut in the predetermined color space.

* * * * *